US009254068B2

(12) United States Patent
Ciavarella et al.

(10) Patent No.: US 9,254,068 B2
(45) Date of Patent: Feb. 9, 2016

(54) SEQUENCED ADJUSTABLE VOLUME PUMPS, REFILL UNITS AND DISPENSERS

(71) Applicant: GOJO Industries, Inc., Akron, OH (US)

(72) Inventors: Nick E. Ciavarella, Seven Hills, OH (US); Jonathan E. Fawcett, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 255 days.

(21) Appl. No.: 13/750,640

(22) Filed: Jan. 25, 2013

(65) Prior Publication Data

US 2014/0209638 A1 Jul. 31, 2014

(51) Int. Cl.

| | |
|---|---|
| ***B67D 7/76*** | (2010.01) |
| ***A47K 5/12*** | (2006.01) |
| ***A47K 5/16*** | (2006.01) |

(52) U.S. Cl.

CPC .... *A47K 5/12* (2013.01); *A47K 5/16* (2013.01)

(58) Field of Classification Search

USPC ..... 222/190, 401, 189.11, 383.1, 383.3, 222/394, 399

See application file for complete search history.

(56) References Cited

U.S. PATENT DOCUMENTS

| | | | | |
|---|---|---|---|---|
| 5,445,288 | A * | 8/1995 | Banks | 222/95 |
| 6,082,586 | A * | 7/2000 | Banks | 222/95 |
| 7,823,751 | B2 * | 11/2010 | Ophardt et al. | 222/137 |
| 7,861,895 | B2 * | 1/2011 | Ray | 222/189.11 |
| 8,047,403 | B2 * | 11/2011 | Quinlan et al. | 222/190 |
| 8,047,404 | B2 * | 11/2011 | Quinlan et al. | 222/190 |
| 8,267,284 | B2 * | 9/2012 | Ray | 222/190 |
| 8,313,010 | B2 * | 11/2012 | Quinlan et al. | 222/190 |
| 2007/0023454 | A1 * | 2/2007 | Ophardt | 222/190 |
| 2014/0084029 | A1 * | 3/2014 | Kerr et al. | 222/190 |

* cited by examiner

*Primary Examiner* — Donnell Long
(74) *Attorney, Agent, or Firm* — Calfee, Halter & Griswold LLP

(57) ABSTRACT

Embodiments of sequenced foam pumps, refill units and dispensers are disclosed herein. One exemplary refill unit includes a container for holding a foamable liquid and a sequenced pump. The sequenced pump has a housing with a chamber located within the housing. There is an air inlet and a liquid inlet into the chamber. A hollow valve stem is movable within the chamber. A sealing member forms a seal between the valve stem and the chamber. When the valve stem is in a first position liquid flows into the chamber and air in the chamber flows into the container; and when the valve stem is in a second position, the sealing member seals off the liquid inlet, and air travels through the air inlet and mixes with the liquid in the chamber. The air and liquid mixture travels through the center of the valve stem and out of an outlet.

23 Claims, 7 Drawing Sheets

SEQUENCED ADJUSTABLE VOLUME PUMPS, REFILL UNITS AND DISPENSERS

TECHNICAL FIELD

The present invention relates generally to pumps, dispensers and refill units and more particularly to sequenced foam pumps, dispensers and refill units having sequenced foam pumps.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles.

SUMMARY

Embodiments of sequenced foam pumps, refill units with sequenced foam pumps and dispensers utilizing sequence foam pumps are disclosed herein. One exemplary refill unit for a foam dispenser includes a container for holding a foamable liquid and a sequenced pump secured to the container. The sequenced pump has a housing with a chamber located within the housing. There is an air inlet into the chamber and a liquid inlet into the chamber. A valve stem having a hollow interior portion is movable within the chamber. The valve stem includes at least one aperture through the outside of the valve stem to the hollow interior of the valve stem. A sealing member forms a seal between the valve stem and the chamber. The refill unit also includes an outlet nozzle. During a first sequence, the valve stem is in a first position and liquid flows from the container into the chamber and air in the chamber travels into the container; and during a subsequent sequence the valve stem is in a second position, the sealing member seals off the liquid inlet, and air travels through the air inlet and mixes with the liquid in the chamber. The air and liquid mixture travels through the aperture and into the center of the valve stem and out of the outlet nozzle.

In addition, exemplary methods of producing a foam product using a sequenced foam pump are disclosed herein. One exemplary method of dispensing a foam product includes moving a valve stem to a first position to open a liquid inlet and allow liquid to flow from a container into a chamber and moving the valve stem to a second position to close the liquid inlet. The methodology includes forcing air under pressure into the chamber to mix with the liquid while the valve stem is in the second position and forcing the mixture to travel through a mix media and be dispensed out of an outlet as a foam.

An exemplary embodiment of a gravity-fed sequenced adjustable foam pump includes a housing, a liquid inlet into the housing, an air inlet into the housing and a valve stem movable within the housing. The valve stem is movable between a first position that seals off the liquid inlet and a second position that opens the liquid inlet. A sealing member is included for forming a seal between the valve stem and the housing. When the valve stem is in the first position, liquid flows into the housing through the liquid inlet. When the valve stem is in a second position, the liquid inlet is sealed off. When the valve stem is in the second position, air is forced into the housing and the air and liquid mixture is forced into a hollow center of the valve stem and is dispensed as a foam.

An exemplary embodiment of a self-venting refill unit includes a container for holding a liquid and a pump connected to the container. The pump includes a housing with a chamber located within the housing. The housing includes a liquid inlet and an air inlet. A valve stem is movable within the chamber. The valve stem moves from a first position that closes off the liquid inlet to a second position that opens the liquid inlet. Air from the air inlet passes into the chamber and mixes with the liquid and the air and liquid mixture are expelled from the pump as a foam; and when the valve stem moves back to the second position and opens the liquid inlet, air from the chamber flows into the container.

BRIEF DESCRIPTION OF THE DRAWINGS

These and other features and advantages of the present invention will become better understood with regard to the following description and accompanying drawings in which.

DETAILED DESCRIPTION

Figure 1:
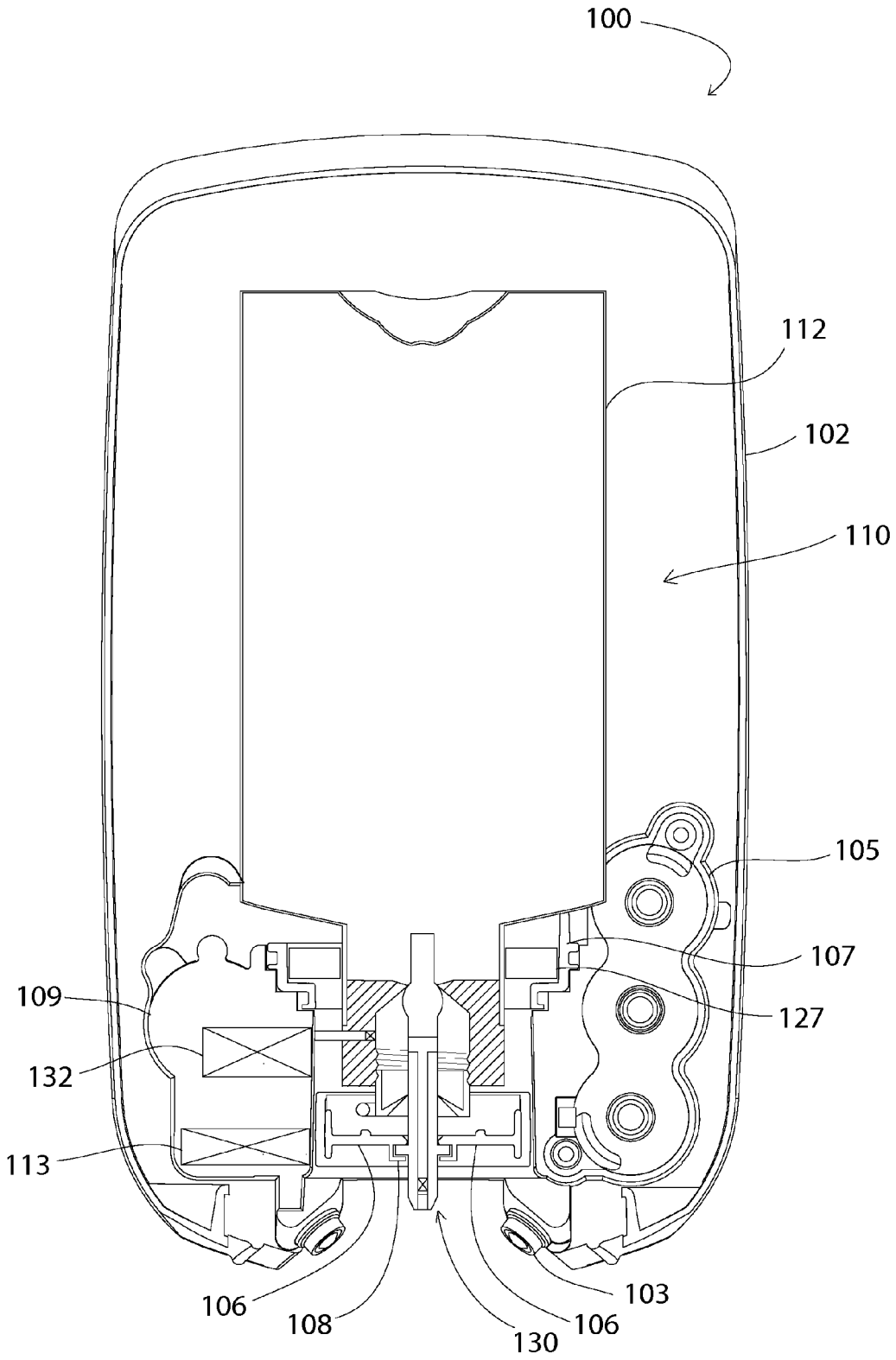
FIG. 1 illustrates a cross-section of an exemplary embodiment of a dispenser and refill unit for a sequenced foam pump.

FIG. 1 is a cross-sectional view of an exemplary dispenser 100 and a refill unit 110 for dispensing a foam. The foam may be any type of foam, such as, for example, a soap, a sanitizer or a lotion. The exemplary dispenser disclosed and described herein is an electrically-operated, touch-free dispenser 100; however, other types of dispensers may be used, such as, for example, manually-operated dispensers. Manual dispensers may be actuated with a push bar, a lever, a pull actuator or the like provided that the dispenser contains suitable mechanisms to sequence the valve stem and air compressor as described herein.

Dispenser 100 includes housing 102. Located within housing 102 is power supply 105. Power supply 105 may be a 6 VDC power supply, such as, for example, a plurality of batteries. Optionally, power supply 105 may be a transformer and/or rectifier if the dispenser 100 is connected to, for example, a 120 VAC power source. In addition, dispenser 100 includes circuitry on circuit board 109, an object sensor 103 and a motor 113 and associated gearing (not shown) to operate actuator 106 and air compressor 132.

Dispenser 100 also includes a holder 107 for receiving a refill unit 110. Holder 107 may include a retention mechanism, such as, for example, a rotatable lock ring (not shown) that rotates to engage and disengage with refill unit 110. In such a case, a collar 127 is connected to refill unit 110 and may include engagement tabs (not shown) to releasably interlock with a rotatable lock ring.

Housing 102 includes an actuator 106 movable in an up-and-down motion by a motor 113 and associated gearing (not shown). In addition, motor 113 includes associated gearing (not shown) for operating air compressor 132. Optionally, a separate motor may be used to operate the air compressor 132.

Refill unit 110 includes a container 112 for holding a foamable liquid and the wet end of foam pump 130. The wet end of foam pump 130 comes into contact with the liquid. Dispenser 100 includes an integrated air compressor 132 that releasably mates with refill unit 110. Air compressor 132 may be any type of air compressor, such as, for example, a piston pump, a diaphragm pump, a bellows pump, a dome pump, a rotary air compressor or the like. This exemplary embodiment is a split foam delivery system which allows the portions that come into contact with the liquid to be disposed of when the refill unit 110 is empty and isolates the air compressor from the liquid so that the air compressor may be permanently mounted in the dispenser and used to provide air for many refill units. In some embodiments, the air compressor is connected to and is part of refill unit 110. In such embodiments, an actuator (not shown) in dispenser 100 is used to actuate the air compressor.

Figure 2:
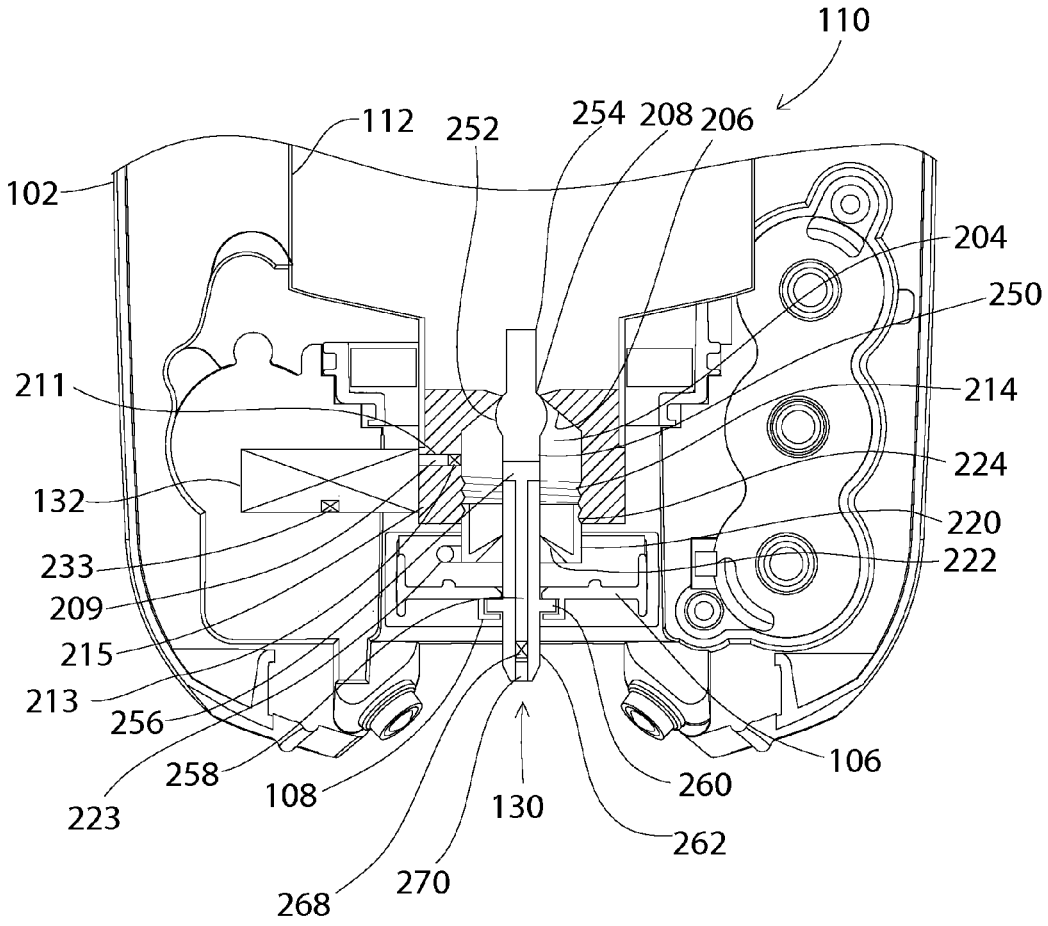
FIG. 2 illustrates an enlarged view of the cross-section of a dispenser with a refill unit having a pump in the primed position.
Figure 3:
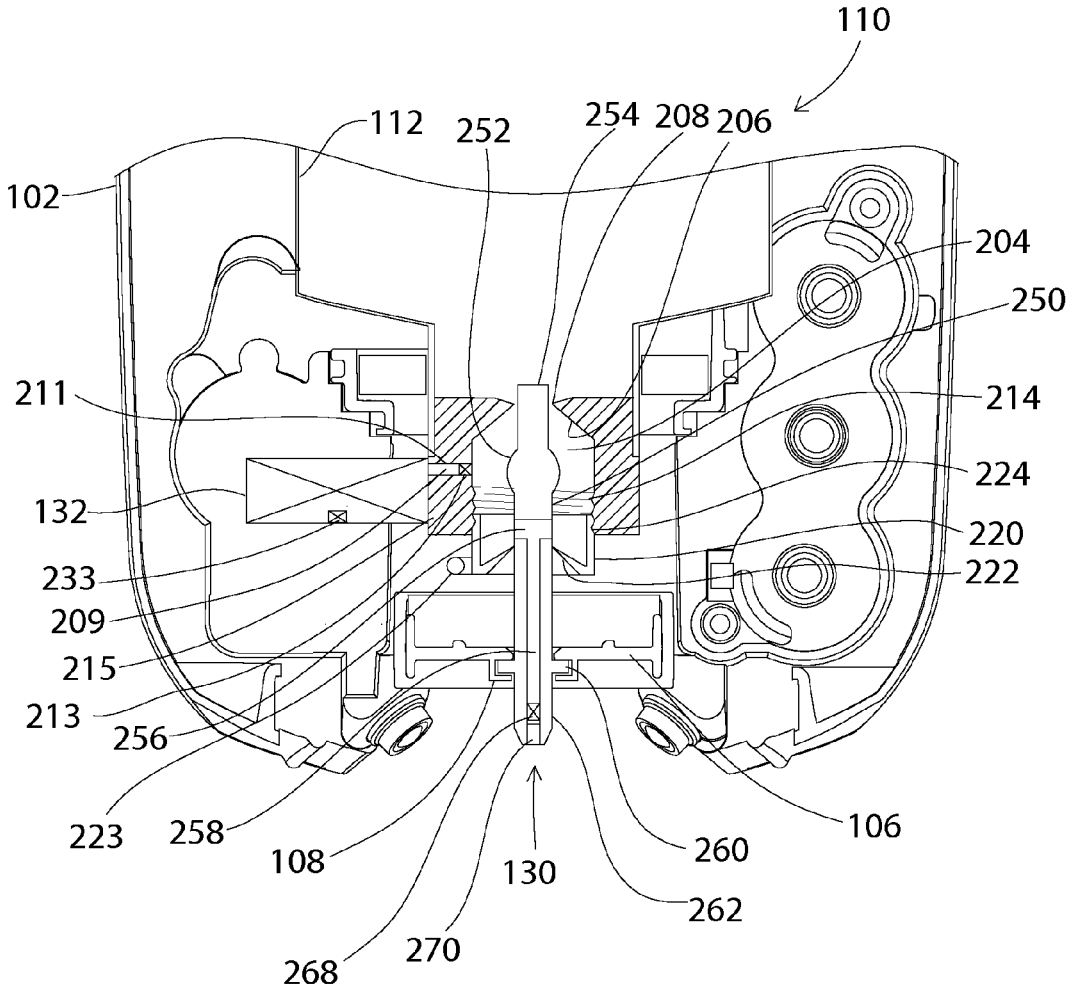
FIG. 3 illustrates an enlarged view of the cross-section of a dispenser with the refill unit having the pump in a charging or priming position.

FIGS. 2 and 3 are enlarged views of a portion of the exemplary dispenser 100 and refill unit 110 installed in the dispenser 100. Refill unit 110 includes a container 112, a pump housing 215, valve stem 250 and adjustable collar 220. Refill unit 110 may be readily removed from the dispenser 100 by, for example, pulling the refill unit straight forward.

Pump housing 215 includes a pump cavity 204. Pump cavity 204 includes an annular opening 208 surrounded by valve seat 206. Annular opening 208 serves as a liquid inlet. In addition, pump housing 215 includes an air passage 211. In some embodiments, a one-way air inlet valve 213 is located in air passage 211 and allows air to flow into pump cavity 204 but prevents air or liquid from flowing out of pump cavity 204 into air passage 211. Accordingly, the one-way air inlet valve 213 prevents contamination or contact of the portions of the dispenser that remain with the dispenser housing when the refill unit is removed with liquid.

Pump housing 215 includes a threaded portion 214. A collar 220, which also includes a threaded portion 224, mates with threaded portion 214. Collar 220 includes a seal member 222, which may be for example a wiper seal, an o-ring seal, a double wiper seal or the like. Collar 220 forms part of the boundary of pump cavity 204.

Collar 220 is rotatable with respect to pump housing 215. Clockwise rotation of collar 220 moves collar 220 upward which decreases the volume of pump cavity 204. Counterclockwise rotation of collar 220 moves collar 220 downward and increases the volume of pump cavity 204. In some embodiments, collar 220 also includes a tab or lever 223 that may be used to rotate collar 220. The volume of pump cavity 204 may be set at the factory before shipping refill unit 110, or may be field adjustable when installing a refill unit 110 in a dispenser 100.

In one embodiment, the lever 223 may be used in the field to select a desired output dose. For example, if lever 223 is in the position illustrated in FIG. 2, the refill unit 110 is set to dispense a full dose. If the lever 223 is rotated clockwise to a first position, the refill unit 110 is set to dispense a smaller dose and if the lever 223 is rotated until it reaches a stop (not shown), the refill unit 110 is set to dispense its smallest dose.

Pump 130 includes a valve stem 250. Valve stem 250 is hollow and has one or more apertures 256 that lead to an interior passage 258. Located within interior passage 258 is a one-way outlet valve 268. Located downstream of one-way outlet valve 268 is a mix media 270. Mix media 270 may be one or more screens, baffles, a porous member, a sponge or the like, to help agitate the liquid and air mixture being forced through the mix media to form a foam.

Valve stem 250 includes a bulb 252 and an upper guide portion 254. In addition, valve stem 250 includes an annular projection 260 that is configured to engage with actuator 106, which includes arms 108 for retaining annular projection 260 during operation. In some embodiments, bulb 252 is sized small enough so that during assembly, bulb 252 may be pushed up through sealing member 222 of collar 220 and large enough to seat against valve seat 206 of pump housing 215 to seal off pump cavity 204 from container 112. Upper guide portion 254 may be cylindrical in shape, or may be formed as a plurality of ribs to allow for a greater fluid flow into pump cavity 204 when bulb 252 is not seated against valve seat 206 (as illustrated in FIG. 3). In some embodiments, channels (not shown) may be added to upper guide portion 254 to allow greater fluid flow.

Dispenser 100 includes air compressor 132 with an air outlet 209. Air outlet 209 engages with air inlet 211 of pump housing 215. Air outlet 209 may be sealed with air inlet 211 by any means, such as, for example, a sealing member, a tight fit between pump housing 215 and dispenser 100, a mating connection (not shown) or the like.

In some embodiments the air outlet 209 to the air compressor 132 of the dispenser 100 is located in the back of the dispenser 100. The air outlet 209 may include a projection (not shown) that projects forward. The air inlet 211 of the pump housing 215 is located in the back of the refill unit 110 so that when the refill unit 110 slides into place, the air inlet 211 mates with the air outlet 209. In such an example, the air inlet 211 may have a conical, or funnel shape and the air outlet 209 may have a projection that fits into the funnel shape and forms a seal. Another exemplary sealing mechanism is shown and described in FIG. 4.

Figure 4:
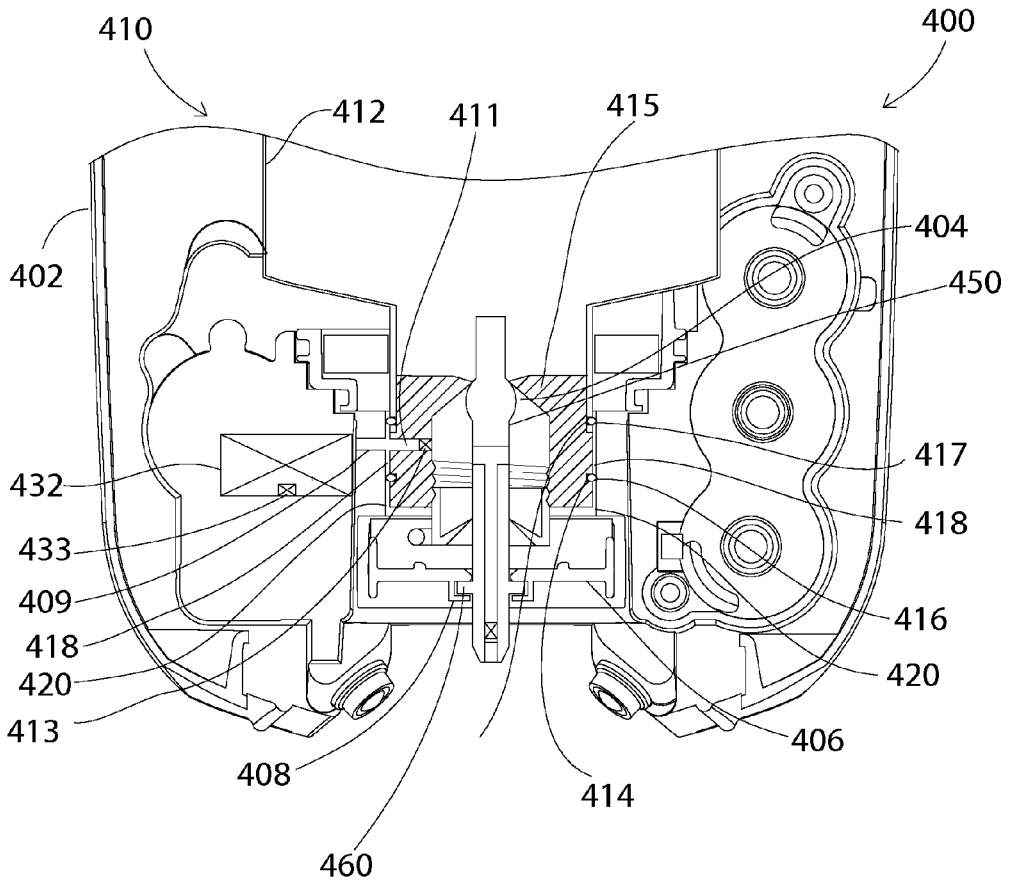
FIG. 4 is an enlarged view of a cross-section of another dispenser with a refill unit located therein.

FIG. 4 illustrates another exemplary embodiment of a dispenser 400 having a refill unit 410 installed in the dispenser 400. For the sake of simplicity, certain features that are similar to those described above are not re-identified and described again. The exemplary embodiment of the dispenser 400 includes an air compressor 432 and has a refill unit 410 installed in the dispenser 400. The refill unit 410 includes a container 412, a pump housing 415 and valve stem 450. Pump housing 415 includes a pump cavity 404 having an air passage 411 and a one-way air inlet valve 413. Pump housing has a first annular groove 407 located above the air passage 411 and a second annular groove 414 located below the air passage 411. A first sealing member 417 (such as, for example, an o-ring) is located in first annular groove 407 and a second sealing member 416 (such as, for example, an o-ring) is located in second annular groove 414. When the refill unit 410 is installed in the dispenser 400 the first and second sealing members 417, 416 contact seal engagement member 420, which may be a wall of dispenser 400 and provide a sealed air passage 418 between the air outlet 409 of air compressor 432 and the air inlet 411 of pump housing 404. In this exemplary embodiment, the refill unit 410 is inserted by lowering the refill down into place with the actuator 406 pulled back to allow annular projection 460 to move into place and then actuator 406 moves forward to trap annular projection 460 between the bottom of actuator 406 and projection member 408.

In some embodiments, valve stem 450 (or the other valve stems disclosed herein) includes a biasing member (not shown) to bias valve stem 450 upward. In such cases, projection 408 would not be needed to move the actuator 406 upward to seal off the pump cavity 404 from the container 412.

In addition, in some embodiments, passage 418 only extends part-way around pump housing 415 and is sealed off by a portion of the pump housing 415 (not shown) that protrudes outward and seals against seal engagement member 420. Thus, in such an embodiment, the refill unit 410 may be slid into the dispenser 400 from the front while still providing an air channel, such as air channel 418, partly around the pump housing 415 and allowing for some misalignment of the refill unit 410 when inserting it into the dispenser 400.

Figure 5:
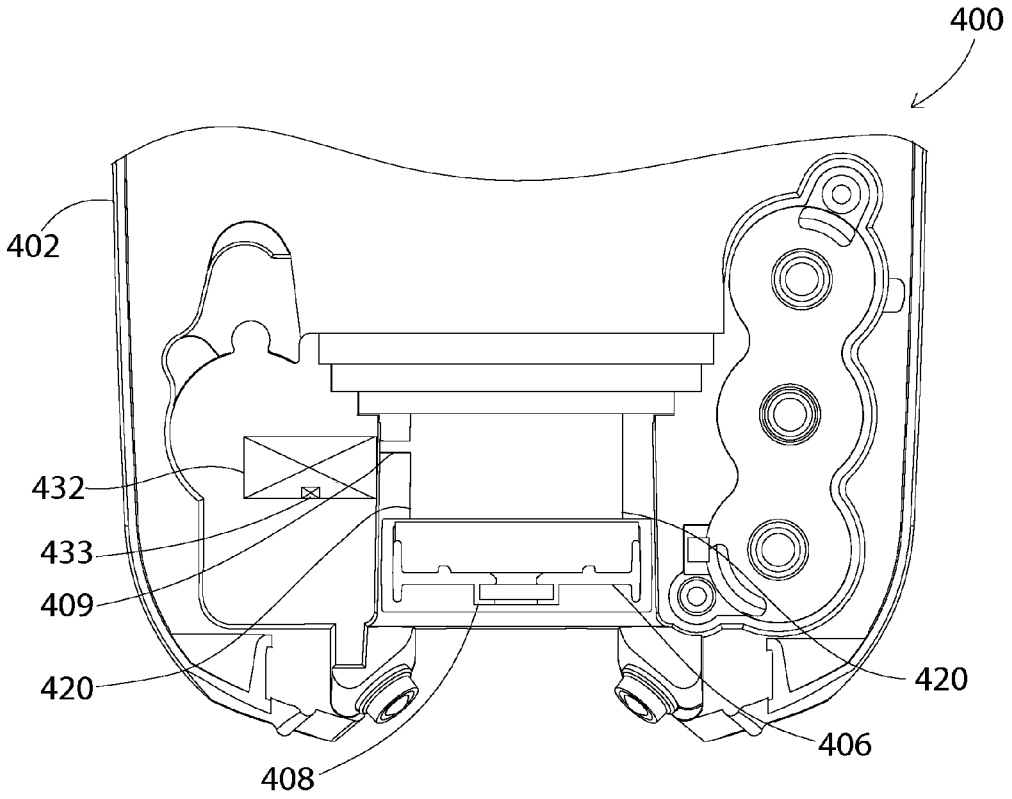
FIG. 5 is a cross-section of the dispenser shown in FIG. 1 with the refill unit removed.
Figure 6:
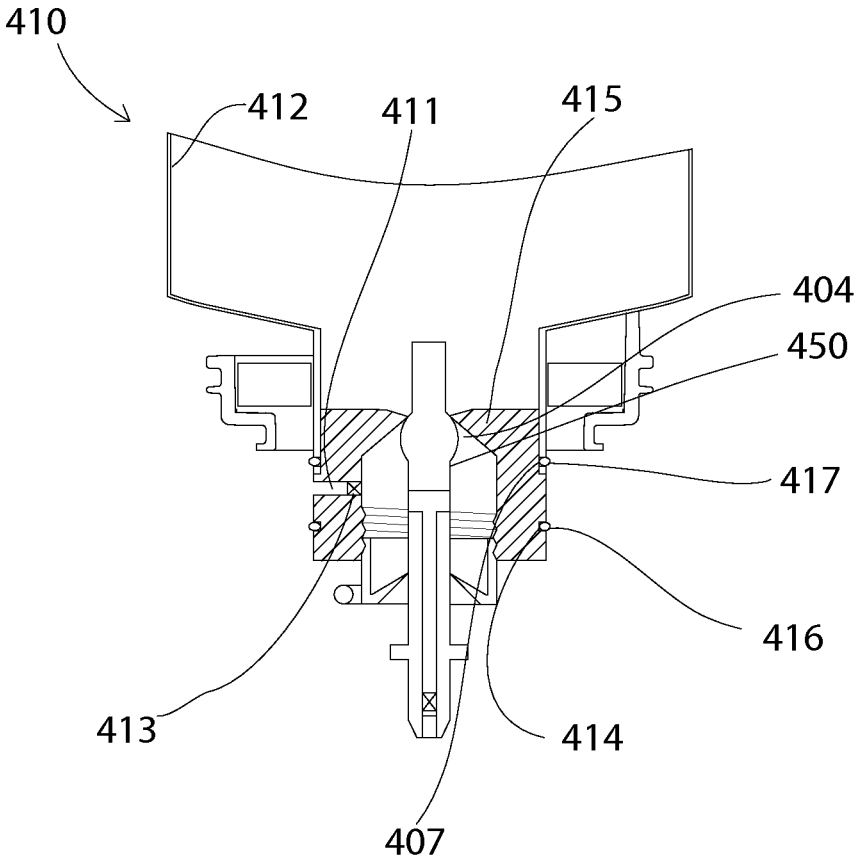
FIG. 6 is a cross-section of the refill unit of FIG. 1 removed from the dispenser.

FIG. 5 is a cross-sectional view of the dispenser 400 without refill unit 410 installed. FIG. 6 is a cross-sectional view of refill unit 410 without the refill unit 410 being installed in the dispenser 400.

The exemplary operation of the sequenced foam pump 130 begins during the refill or priming stage illustrated in FIG. 3. Actuator 106 lowers the valve stem 250, which includes bulb 252, to allow foamable liquid to flow from container 112 into pump cavity 204. Then the valve stem 250 and bulb 252 are moved upward by actuator 106 so that bulb 252 contacts and seals against valve seat 206. Then air compressor 132 is actuated forcing air to flow through air compressor outlet 209, into pump housing 215 through air inlet 211, past air inlet valve 213 and into pump cavity 204. The incoming air mixes with the foamable liquid and the liquid/air mixture flows through aperture 256, through the passage 223 in valve stem 250, past one-way outlet valve 268, through mix media 270 and out of outlet 262 where it is dispensed as a foam.

At that point, air compressor 132 is stopped and re-primed. In some embodiments, such as, for example, if the air compressor 132 is a piston pump or a dome pump, as the air chamber (132) in the air compressor 132 expands, air flows into the air compressor 132 through a one-way air inlet valve 233. As the actuator 106 moves the valve stem 250 and bulb 252 downward, air in the pump cavity 204 flows into container 112 thereby venting the container 112, and liquid flows into pump cavity 204. At this point, the pump 130 is primed and ready for another dispense cycle.

Figure 7:
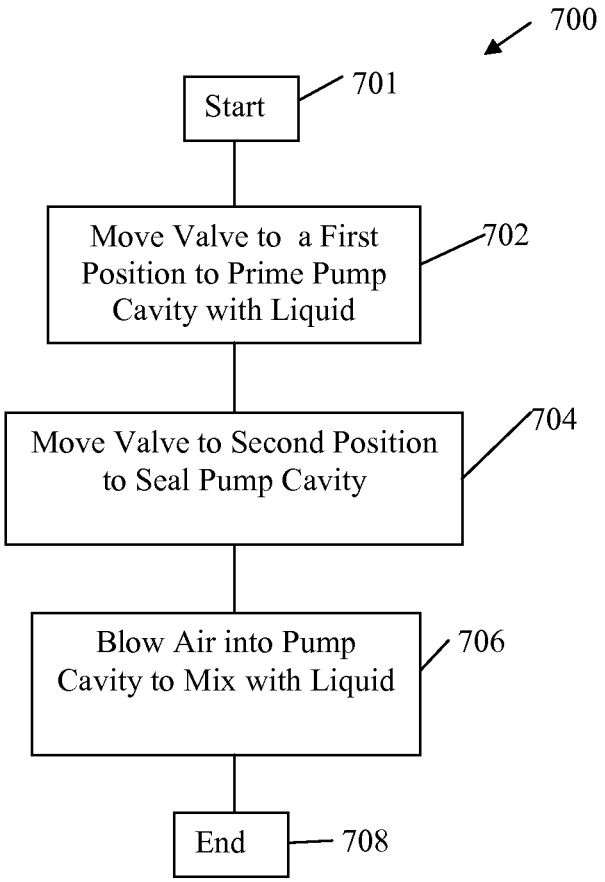
FIG. 7 illustrates an exemplary block diagram of a sequence for operating a foam dispenser.

FIG. 7 illustrates an exemplary methodology for a sequenced foam pump operation 700. Although the exemplary methodology discloses the steps in a certain order, the exemplary methodology is not limited to a certain process order, or to all of the steps listed in the exemplary methodology. In addition, additional steps, or sub-steps may be included. The sequence begins at block 701. At block 702 the valve is moved to a first position to prime the liquid pump cavity with foamable liquid from a container. When the pump cavity is filled with foamable liquid, the valve is moved to a second position sealing the pump cavity at block 704. An air compressor is activated at block 706 to force pressurized air into the pump cavity to mix with the liquid. The air pressure forces the liquid/air mixture to flow out of the dispenser and be dispensed as a foam.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A refill unit for a foam dispenser comprising:
a container for holding a foamable liquid;
a sequenced pump secured to the container;
the sequenced pump comprising:
a housing;
a chamber located within the housing;
an air inlet into the chamber;
a liquid inlet into the chamber;
a valve stem having a hollow interior portion;
at least one aperture through the outside of the valve stem to the hollow interior of the valve stem;
a sealing member that forms a seal between the valve stem and the chamber; and
an outlet nozzle;
wherein during a first sequence, the valve stem is in a first position and liquid flows from the container into the chamber, and air in the chamber travels into the container; and
wherein during a subsequent sequence, the valve stem is in a second position and seals off the liquid inlet from the container, and air travels through the air inlet and mixes with the liquid in the chamber; and
the air and liquid mixture travels through the aperture and into the center of the valve stem and out of the outlet nozzle.

2. The refill unit of claim 1 further comprising an adjustment member for adjusting the volume of the chamber.

3. The refill unit of claim 1 further comprising a mix media secured to the valve stem, wherein the mix media is in fluid communication with the interior of the valve stem.

4. The refill unit of claim 1 further comprising an air pump in fluid communication with the air inlet.

5. The refill unit of claim 1 further comprising a foamable liquid in the container.

6. The refill unit of claim 1 further comprising a valve stem guide member.

7. A method of dispensing a foam product comprising:
moving a valve stem to a first position to open a liquid inlet and allow liquid to flow from a container into a chamber;
moving the valve stem to a second position to close the liquid inlet;
forcing air under pressure into the chamber to mix with the liquid while the valve stem is in the second position; and
forcing the mixture to travel through a mix media and be dispensed out of an outlet as a foam.

8. The method of claim 7 further comprising venting the container by moving the liquid valve stem to the first position.

9. A gravity fed foam pump comprising:
a housing;
a liquid inlet into the housing;
an air inlet into the housing;
a valve stem movable within the housing;
the valve stem movable between a first position that seals off the liquid inlet and a second position that opens the liquid inlet;
a sealing member for sealing between the valve stem and the housing;
wherein when the valve stem is in the second position, liquid flows into the housing through the liquid inlet and air flows out of the housing;
wherein when the valve stem is in a first position the liquid inlet is sealed off; and
air is forced into the housing when the valve stem is in the second position and the air and liquid mixture is forced into a hollow center of the valve stem and is dispensed as a foam.

10. The gravity fed foam pump of claim 9 further comprising an air pump secured to the housing.

11. The gravity fed foam pump of claim 9 further comprising a container for holding a foamable liquid.

12. The gravity fed foam pump of claim 11 further comprising a foamable liquid in the container.

13. A self-venting refill unit comprising:
a container for holding a liquid;
a pump connected to the container;
the pump having a housing;
a chamber located within the housing
a liquid inlet;
an air inlet;
a valve stem movable within the chamber;
the valve stem moving from a first position that closes off the liquid inlet and a second position that opens the liquid inlet;
wherein air from the air inlet passes into the chamber and mixes with the liquid and the air and liquid are expelled from the pump as a foam; and
wherein when the valve stem moves to the second position and opens the liquid inlet, air from the chamber flows into the container.

14. The self-venting refill unit of claim 13 further comprising a sealing member to form a seal between the valve stem and the housing and form at least a portion of the chamber.

15. The self-venting refill unit of claim 14 wherein the air and liquid mixture passes through the center of the valve stem.

16. The self-venting refill unit of claim 15 wherein an outlet valve is located proximate the hollow center of the valve stem.

17. The self-venting refill unit of claim 16 wherein a mix media is located proximate the hollow center of the valve stem.

18. The self-venting refill unit of claim 15 further comprising a foamable liquid in the container.

19. A refill unit for a foam dispenser comprising:
a container for holding a foamable liquid;
a sequenced pump secured to the container;
the sequenced pump comprising:
a housing;
a chamber located within the housing;
an air inlet into the chamber;
a liquid inlet into the chamber;
a valve stem having a hollow interior portion;
at least one aperture through the outside of the valve stem to the hollow interior of the valve stem;
a sealing member that forms a seal between the valve stem and the chamber; and
an outlet nozzle;
wherein during a first sequence, the valve stem is in a first position and liquid flows from the container into the chamber, and air in the chamber travels into the container; and
wherein during a subsequent sequence, the valve stem is in a second position and seals off the liquid inlet from the container, and air travels through the air inlet and mixes with the liquid in the chamber;
the air and liquid mixture travels through the aperture and into the center of the valve stem and out of the outlet nozzle; and
an adjustment member for adjusting the volume of the chamber;
wherein the adjustment member includes the sealing member.

20. A refill unit for a foam dispenser comprising:
a container for holding a foamable liquid;
a sequenced pump secured to the container;
the sequenced pump comprising:
a housing;
a chamber located within the housing;
an air inlet into the chamber;
a liquid inlet into the chamber;
a valve stem having a hollow interior portion;
at least one aperture through the outside of the valve stem to the hollow interior of the valve stem;
a sealing member that forms a seal between the valve stem and the chamber; and
an outlet nozzle;
wherein during a first sequence, the valve stem is in a first position and liquid flows from the container into the chamber, and air in the chamber travels into the container; and
wherein during a subsequent sequence, the valve stem is in a second position and seals off the liquid inlet from the container, and air travels through the air inlet and mixes with the liquid in the chamber;
the air and liquid mixture travels through the aperture and into the center of the valve stem and out of the outlet nozzle; and
an adjustment member for adjusting the volume of the chamber;
wherein the adjustment member is rotatable to adjust the volume of the chamber.

21. A refill unit for a foam dispenser comprising:
a container for holding a foamable liquid;
a sequenced pump secured to the container;
the sequenced pump comprising:
a housing;
a chamber located within the housing;
an air inlet into the chamber;
a liquid inlet into the chamber;
a valve stem having a hollow interior portion;
at least one aperture through the outside of the valve stem to the hollow interior of the valve stem;
a sealing member that forms a seal between the valve stem and the chamber; and
an outlet nozzle;
wherein during a first sequence, the valve stem is in a first position and liquid flows from the container into the chamber, and air in the chamber travels into the container; and
wherein during a subsequent sequence, the valve stem is in a second position and seals off the liquid inlet from the container, and air travels through the air inlet and mixes with the liquid in the chamber;
the air and liquid mixture travels through the aperture and into the center of the valve stem and out of the outlet nozzle; and
an outlet valve secured to the valve stem, and the outlet valve is located at least partially within the interior of the valve stem.

22. A gravity fed foam pump comprising:
a housing;
a liquid inlet into the housing;
an air inlet into the housing;
a valve stem movable within the housing;
the valve stem movable between a first position that seals off the liquid inlet and a second position that opens the liquid inlet;
a sealing member for sealing between the valve stem and the housing;

wherein when the valve stem is in the second position, liquid flows into the housing through the liquid inlet;

wherein when the valve stem is in a first position the liquid inlet is sealed off; and air is forced into the housing when the valve stem is in the second position and the air and liquid mixture is forced into a hollow center of the valve stem and is dispensed as a foam;

wherein the sealing member is movable between a first position and a second position, and movement of the sealing member from the first position to the second position changes the volume of foam dispensed from the pump.

23. A self-venting refill unit comprising:

a container for holding a liquid;

a pump connected to the container;

the pump having a housing;

a chamber located within the housing a liquid inlet;

an air inlet;

a valve stem movable within the chamber;

the valve stem moving from a first position that closes off the liquid inlet and a second position that opens the liquid inlet;

wherein air from the air inlet passes into the chamber and mixes with the liquid and the air and liquid are expelled from the pump as a foam; and wherein when the valve stem moves to the second position and opens the liquid inlet, air from the chamber flows into the container;

a sealing member to form a seal between the valve stem and the housing and form at least a portion of the chamber;

wherein the sealing member is movable within the chamber and the volume of the chamber may be adjusted by changing the position of the sealing member.

* * * * *